United States Patent [19]

Theurer

[11] 4,334,479

[45] Jun. 15, 1982

[54] METHOD AND APPARATUS FOR OBTAINING A CONTROLLED DEGREE OF BALLAST COMPACTION IN THE TAMPING AND LEVELING OF A TRUCK

[75] Inventor: Josef Theurer, Vienna, Austria

[73] Assignee: Franz Plasser Bahnbaumaschinen-Industriegesellschaft m.b.H., Vienna, Austria

[21] Appl. No.: 556,177

[22] Filed: Mar. 6, 1975

Related U.S. Application Data

[62] Division of Ser. No. 438,264, Jan. 31, 1974, Pat. No. 3,910,195.

[30] Foreign Application Priority Data

Apr. 26, 1973 [AT] Austria ..... 3742

[51] Int. Cl.[3] ..... E01B 27/17; E01B 33/02

[52] U.S. Cl. ..... 104/12; 104/7 R

[58] Field of Search ..... 104/7, 8, 12; 37/104; 171/16

[56] References Cited

U.S. PATENT DOCUMENTS

| | | | |
|---|---|---|---|
| 3,143,974 | 8/1964 | Oville | 104/12 |
| 3,545,384 | 8/1970 | Plasser et al. | 104/12 |
| 3,595,170 | 7/1971 | Plasser et al. | 104/12 |
| 3,744,428 | 7/1973 | Plasser et al. | 104/12 |
| 3,807,311 | 4/1974 | Plasser et al. | 104/12 |

FOREIGN PATENT DOCUMENTS

| | | | |
|---|---|---|---|
| 355170 | 8/1961 | Switzerland | 104/12 |

*Primary Examiner*—Richard A. Bertsch
*Attorney, Agent, or Firm*—Kurt Kelman

[57] ABSTRACT

A controlled degree of ballast compaction is obtained with a mobile track tamping and leveling machine which comprises a track holding device holding the track at a leveled position under the control of an error signal from a reference system. The ballast is compacted under the points of intersection between the track rails and ties by a pair of opposed vibratory tamping tools arranged for immersion in the cribs adjacent a tie and for reciprocation in the direction of track elongation, with the tie positioned between the opposed tools, and an additional vibratory tamping tool arranged for immersion in the ballast adjacent the end of the tie and for reciprocation in a direction transverse to the track elongation. The ballast is pressed against the held track until it has reached a controlled degree of compaction, a control for regulating the compaction degree regulating the drives for reciprocation and vibration of the tamping tools.

17 Claims, 5 Drawing Figures

METHOD AND APPARATUS FOR OBTAINING A CONTROLLED DEGREE OF BALLAST COMPACTION IN THE TAMPING AND LEVELING OF A TRUCK

This is a division of application Ser. No. 438,264, filed Jan. 31, 1974, now U.S. Pat. No. 3,910,195, dated Oct. 7, 1975.

The present invention relates to improvements in track surfacing operations, and more particularly in the tamping and leveling of a track consisting of rails mounted on ties having two elongated edges extending transversely of the rails and two ends extending in the direction of the rails, the rails and ties intersecting at points spaced in the direction of elongation of the track and the ties resting on ballast. The elongated edges of adjacent ones of the ties define cribes therebetween, and the track is leveled or graded in relation to a reference system.

In known track leveling methods, the ballast is compacted under the ties, and more particularly under the points of intersection, by vibratory pressure exerted upon the ballast under the ties inwardly from the two longitudinal tie edges whereby the progressively more compacted ballast raises the track, the track being independently lifted before and/or during the ballast tamping, if desired, until it has reached the leveled position determined by a reference system including a pickup and transmitter of an error signal for leveling the track in response to the error signal. While such track surfacing has been found quite useful, the desired degree of ballast compaction under the ties has not always been achieved because some ballast is displaced outwardly in a direction transverse to the track while it is squeezed by the vibratory pressure in the track direction.

It has also been proposed to provide mobile track tamping machines with a tamping tool assembly vertically movably mounted on a machine frame for tamping a respective one of the ties, such an assembly comprising a pair of opposed vibratory tamping tools arranged for immersion in the cribs adjacent the tie and for reciprocation in the direction of track elongation, with the tie positioned between the opposed tools, and an additional vibratory tamping tool arranged for immersion in the ballast adjacent the end of the tie and for reciprocation in a direction transverse to the direction of track elongation. With such an arrangement, the ballast is "boxed in" between the tamping tools substantially from the point of intersection of the rail and tie to the end of the tie, thus preventing the outward displacement of ballast during the tamping operation. However, no control over the leveling of the track or the degree of ballast compaction is possible with such known track tampers because they neither comprise a leveling reference nor a tamping control.

It has also known to level track solely by tamping the ballast under the ties. In such track leveling machines, only opposed tamping tools reciprocated in the direction of track elongation are used and a control terminates the tamping operation in response to a reference signal indicating the desired track level. If the track must be raised to the desired level through a considerable lifting stroke, such machines also use independent track lifting mechanisms. However, controlled uniform ballast compaction cannot be achieved with such machines since the ballast may escape laterally when the tamping pressure in the direction of track elongation exceeds a given degree while, in other track sections, the desired track level has been reached before the ballast has been sufficiently compacted.

Furthermore, it has been proposed to assure the maintenance of a desired track level even under high tamping pressures by holding the track in position during tamping, the track holding being so controlled that the track will not be raised beyond the desired level during tamping. This prevents uncontrolled raising of the track but it does not assure the termination of the tamping when a desired degree of ballast compaction has been reached.

Thus, conventional track surfacing methods and apparatus have not been able to assure a desired, preferably uniform and optimal maximum, degree of ballast compaction under each tie over a long track section. It is, therefore, the primary object of this invention to obtain such ballast compaction, which is particularly important in track sections designed for high-speed trains.

This and other objects are accomplished by the method of the invention by holding the track in the leveled position determined by the reference system, the ballast being pressed against the held track until it has reached a controlled degree of compaction and the ballast being compacted under the points of intersection of the ties and rails by vibratory pressure exerted upon the ballast under the ties inwardly from the two longitudinal tie edges and from the tie ends whereby the progressively more compacted ballast raises the track. The track may also be lifted independently of the ballast compaction before or during the compaction. This produces not only a high degree of accuracy in the track level but also an optimally and uniformly compacted ballast bed.

It has been found that the track surfacing method according to the present invention does not disturb the position of those ballast pieces whose sharp edges or corners bite into the underside of wooden ties when the track settles on the ballast bed, thus leaving the ballast enmeshed with the ties. This is of particularly advantage in high-speed traffic sections where the passing trains have strongly settled the track, the method of this invention making it unnecessary to lift the track during leveling with the conventional track lifting mechanism and thus destroying the intermeshing relationship of the ties and ballast. Operating the method of the invention, the ballast pieces remain undisturbed in their relationship to the undersides of the ties and are even pressed further into the undersides when the tamped ballast presses upwardly against the held track. Particularly by the vibratory pressures inwardly from the ends of the ties, high tamping pressures sufficient to raise the track to the desired level may be obtained. This method also assures a particularly sensitive approach of the track to the leveled position since the track is not torn out of its settled position but progressively pressed from the settled into the leveled position, which improves the accuracy of the leveling operation.

According to a preferred embodiment of the method, the desired degree of compaction of the ballast is obtained by changing the amount and/or duration of the pressure and/or the vibration of the tie end tamping tools in respect of the crib tamping tools. This is particularly useful where the operation must be adapted to different ballast conditions along a length of track. Thus, if the vibratory pressure from the end of the tie is increased in respect of that from the longitudinal edges of the tie, the upward pressure of the compacted ballast is correspondingly increased so that the track may be raised to a considerably larger extent only by the ballast tamping and without the need for independent track lifting.

A continuous operation for obtaining the desired optimal degree of ballast compaction will be obtained under all track conditions along a length of track if the track is raised to the leveled position solely by compaction of the ballast when the difference between the actual and leveled track position is small, and the track is also independently lifted when this difference is larger.

A mobile track tamping and leveling machine according to the present invention combines a known type of leveling reference system and a tamping tool assembly which comprises not only a pair of opposed vibratory tamping tools but also an additional vibratory tamping tool adjacent the tie end with a track holding device holding the track at the leveled position controlled by the error signal from the reference system. Furthermore, a control regulates the drive means for the reciprocation and for the vibration of the tamping tools to regulate the degree of ballast compaction.

With this combination of structures mounted on the mobile machine frame, the track will be leveled automatically and the ballast tamping will be terminated automatically when the optimal ballast compaction has been reached, the machine being readily adaptable by the control to differing ballast conditions while assuring long-lasting ballast compaction.

The control regulating means for the tamping tool drives has separate governors associated respectively with the drive means for the opposed tamping tools and the drive means for the additional tamping tool, which makes it possible to control the operation very sensitively in response to differing ballast conditions as the machine proceeds along the length of a track section. For instance, where the ballast bed is relatively loose (for instance after a ballast cleaning operation), lower pressures may be used for the crib tamping tools while higher pressures are used for the reciprocation of the end tamping tool to prevent outward displacement of ballast.

By associating a timing device, for instance a delay or acceleration, with the regulating means for the drive means for the additional tamping tool, all drives will be fully automatically correlated so that the operator may concentrate essentially on observing the measuring devices and track correction operation.

The universal application of the machine will be further enhanced by providing it also with track lining means which includes a second reference system including a pickup and transmitter of an error signal for lining the track in response thereto, the latter error signal pickup and transmitter being coordinated with the control.

The above and other objects, advantages and features of the present invention will become more apparent from the following detailed description of certain now preferred embodiments thereof, taken in conjunction with the accompanying drawing wherein FIG. 1 is a schematic side elevational view of a ballast tamping and track leveling machine with a simple control system according to this invention;

Figure 1:
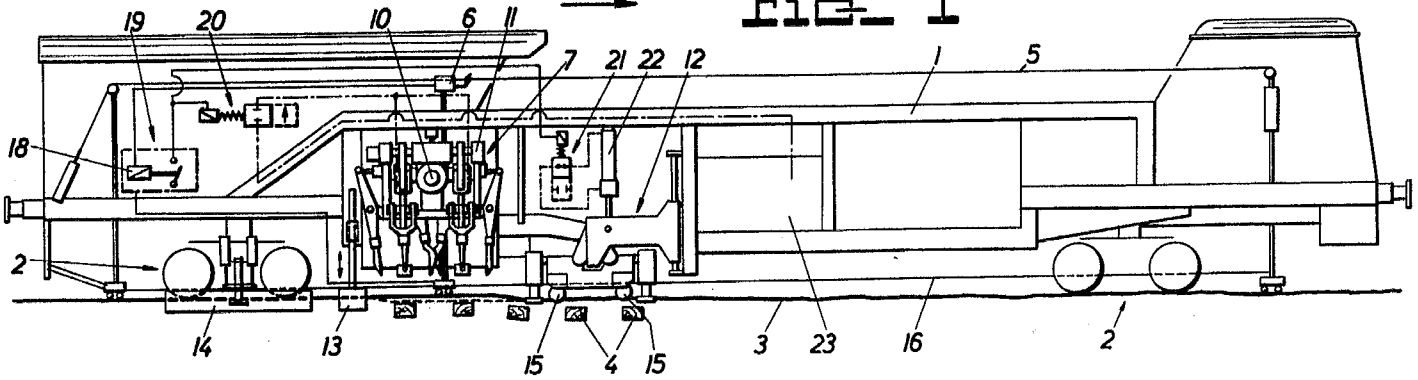
Figure 2:
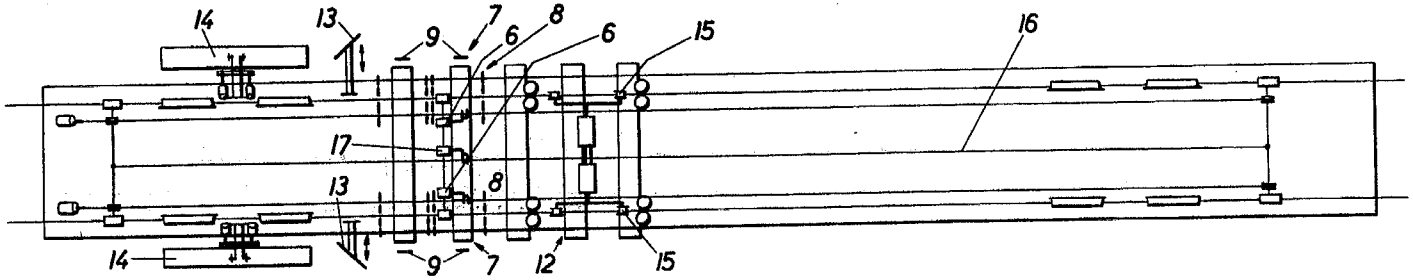
FIG. 2 is a top plan view of FIG. 1.

Referring now to the drawing and first to FIGS. 1 and 2, there is shown a mobile track tamper and liner whose elongated frame 1 is supported on undercarriages 2, 2 spaced apart to provide a long wheel base and running on a track consituted by rails 3 and ties 4 in a working direction indicated by horizontal arrow A, the track ties resting on ballast (not shown). The tamping and leveling machine includes a first reference system including tensioned wire 5 extending from an end point in an uncorrected track section to an end point in the corrected track section. The end points of the reference wire are anchored to bogies running on the track and are vertically movable independently of machine frame 1. To measure the level of the track relative to reference wire 5, a level signal pickup and transmitter 6 cooperates with the wire, such as a rotary coil or potentiometer. All of these structures and their operation are well known in track surfacing operations and, therefore, require no further description herein.

The tamping tool assembly or unit 7 illustrated herein is arranged for simultaneously tamping two adjacent ties 4, the assembly being mounted on machine frame 1 for vertical movement by means of hydraulic jack 24 so that the tamping tools may be positioned from an inoperative position into an operative or tamping position wherein the jaws on the lower ends of the tamping tools are immersed in the ballast underneath the ties. The tamping tool assembly comprises two pairs of opposed vibratory tamping tools 8, which are termed "crib" tamping tools herein, which pairs of tools are so spaced from each other in the direction of elongation of the track that the tools of each pair which are adjacent to each other are at a smaller distance from each other than the distance between adjacent ones of the ties so that the two adjacent tamping tools enter into the same crib when the assembly is lowered. The opposed vibratory tamping tools 8 of each pair are arranged for immersion in the cribs adjacent one of the ties and for reciprocation in the direction of track elongation, with the one tie positioned between the opposed tools of each pair. Such a tamping tool assembly is described and claimed, for instance, in U.S. Pat. Nos. 3,357,366, dated Dec. 12, 1967 and 3,372,651, dated Mar. 12, 1968.

According to the present invention, the tamping tool assembly also includes additional vibratory tamping tools 9, which are termed "end" tamping tools herein, which are arranged for immersion in the ballast adjacent the ends of ties 4 and for reciprocation in a direction transverse to the direction of track elongation, i.e. towards the ends of the ties in the longitudinal direction thereof. Drive 10, which may include a rotary cam shaft, is operatively connected to tamping tools 8 for imparting vibration thereto and drive 11, which may also include a rotary cam shaft, is operatively connected to tamping tools 9 for imparting vibration thereto. Power means are also provided to reciprocate the tamping tools in a manner well known per se, such means including hydraulic cylinders, if desired, or rotary threaded spindles. Non-synchronous reciprocation of the crib tamping tools, such as shown in U.S. Pat. No. 3,357,366, for instance, will be preferred.

The machine frame also carries a track lifting and leveling unit 12 which may be of any suitable design, the illustrated unit including pairs of flanged rail-gripping rollers 15, 15 engaging each rail and mounted on a vertically movable carrier bracket which also carries hydraulic shoes supported on the ballast.

Ballast plows 13, 13 are arranged on the frame rearwardly of the tamping tool assembly, as seen in the working direction, the plows being mounted laterally adjacent the track and being vertically and transversely adjustable to enable ballast to be moved from the shoulder of the ballast bed to the region immediately adjacent the ends of the ties. This makes it possible for the surface tampers 14, which are mounted on frame 1 in the region of the rear wheels 2 of the machine, properly to consolidate or compact the ballast at the tie ends.

As is also well known per se, lining of the track by means of unit 12 is effected in respect of a second reference system 16 which cooperates with measuring signal pickup and transmitter 17 associated with the control for the hydraulic drives of the unit.

The above described mobile track tamping and leveling machine operates as follows:

When the measuring signal pickup and transmitter 6 is aligned with an uneven or uncorrected track section (indicated by broken lines in FIG. 1), the resultant error signal is transmitted therefrom to relay 18 of control device 19 to close a switch in the control circuit. Solenoid valves 20 and 21 are arranged in the control circuit and are actuated upon closing of the control circuit. Solenoid valves 20 and 21 are mounted in the hydraulic fluid supply lines leading from fluid supply tank 23 to the reciprocating drives for the tamping tools and to lifting cylinder 22, respectively. The lifting cylinder is operatively connected to the carrier bracket of lifting and lining unit 12 and, when solenoid valve 21 is actuated by control device 19 triggered by an error signal, the valve is closed and further flow of hydraulic fluid from or to tank 23 is stopped. In this manner, jack 22 becomes a locking device holding unit 12 in its vertical position so that unit 12 becomes a track holding device.

Figure 3:
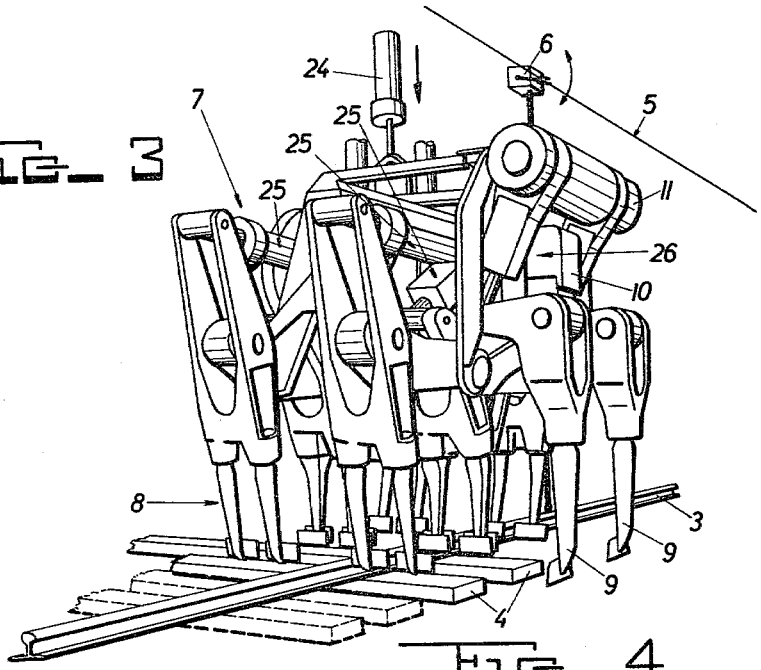
FIG. 3 is an enlarged perspective view of a tamping tool assembly with crib and end tamping tools arranged for the simultaneous tamping of two adjacent ties.

At the same time, hydraulic fluid is supplied to hydraulic jack 24 to lower tamping tool assembly 7 into its working position wherein the crib and end tamping tools 8 and 9 enter into the ballast, and actuation of valve 20 opens the same to permit the flow of hydraulic fluid from tank 23 to the hydraulic drives for reciprocating the tamping tools whereby the ballast is squeezed between the tools underneath the ties, pairs of crib tamping tools being mounted around the points of intersection between ties 4 and rails 3, as shown in FIG. 3, to assure particularly effective ballast tamping at these supports points of the track. The supply of hydraulic fluid to the reciprocating drives, i.e. reciprocation of the tamping tools and further compaction of the ballast underneath the ties, is terminated when the compacted ballast under the ties has so far raised or leveled the track that it has assumed the desired level indicated in full lines in FIG. 1. At this point, the signal from pickup and transmitter 6 will open the switch of control 19 and thus close valve 20 to interrupt the flow of hydraulic fluid to the reciprocating drives. The raising of the track to the desired level will be effectively accomplished in this operation since the end tamping tools will prevent any ballast from being outwardly displaced towards the shoulder of the bed even when the compacting pressure of crib tamping tools 8 is quite high. This makes it possible to obtain a maximum compaction of the ballast for very firm and long lasting support of a leveled track even where the original condition of the bed varies considerably.

If the ballast underneath the ties has not been sufficiently tamped and compacted when the track has been raised to the desired level, the control circuit may be inactivated so that the reciprocation of tamping tools 8 and 9 continues until the desired degree of ballast compaction has been obtained. Since such switching off of the control circuit will also leave unit 12 in its locked position at one side of the leveled track section and rear undercarriage 2 will transmit at least half the weight of the heavy machine to the track at the other side of the leveled track section, the same will be held or pinned down in the leveled position determined by reference system 5 while such additional tamping proceeds.

FIG. 3 shows the tamping tool assembly in greater detail, one such assembly being associated with each rail 3. Each tamping tool assembly 7 is glidably supported on vertical posts on frame 1 and is vertically movable by hydraulic cylinder or jack 24 for tamping two adjacent ties 4 (shown in full lines). In the working position, the crib tamping tools 8 are immersed in the ballast alongside the longitudinal sides of the track ties while end tamping tools 9 are immersed in the ballast alongside the ends of the ties, thus effectively "boxing in" the ballast therebetween and, most particularly, under the points of intersection between the ties and the rails. Drive 10 vibrates tamping tools 9 and drive 11 vibrates tamping tools 8 so that they are vibrated in vertical planes substantially transverse and parallel to the track.

Hydraulic reciprocating drives 25 squeeze the tamping tools 8 of each pair together and move them apart while hydraulic reciprocating drives 26 move end tamping tools 9 towards and away from the tie ends, the well known non-synchronous tamping tool reciprocating drives being particularly useful for this purpose. Any other suitable drive may be used however, for reciprocating the tamping tools.

As shown in FIGS. 1 and 3, measuring signal pickup and transmitter 6 is mounted on a vertical rod running on rail 3 for free vertical movement in response to the level of the rail, as is conventional in track leveling reference systems of the illustrated type.

As is well illustrated in FIG. 3, the tamping tools surround the points of intersection of rail 3 and ties 4 so as to assure solid compaction of the ballast underneath these track support points while avoiding ballast tamping in the center of the ties and/or displacement of ballast towards the shoulders of the bed.

Figure 4:
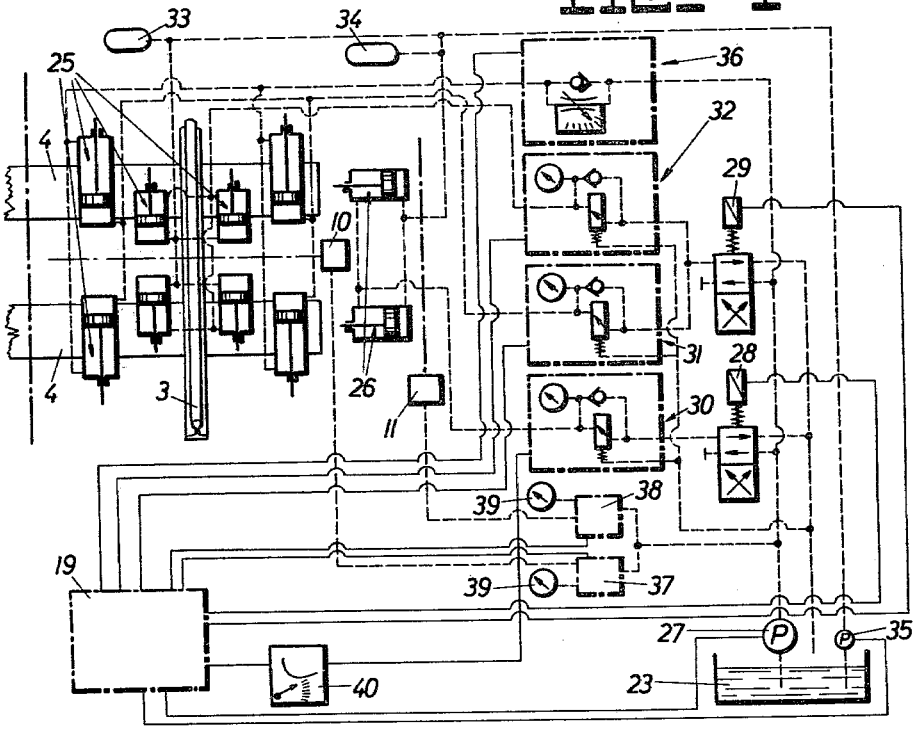
FIG. 4 is a simplified diagram of the control circuit for the operation of the crib and end tamping tools.

The simplified diagram of FIG. 4 shows the control circuit for hydraulic reciprocating drives 25 and 26 for crib tamping tools 8 and end tamping tools 9. In this diagram, the hydraulic fluid supply conduits are shown in broken lines while the electric circuit is shown in full lines. Constant speed pump 27, which has a relatively high capacity, for instance 200 liters of hydraulic fluid per minute, delivers hydraulic fluid from tank 23 through supply conduits to vibratory drives 10, 11 and reciprocatory drives 25, 26. Solenoid valves 28 and 29 are mounted in a supply conduit coming from tank 23 and may be operated to direct the hydraulic fluid respectively to pressure adjustment device or governor 30 and to pressure adjustment devices or governors 31, 32. Each of the pressure adjustment devices 30, 31, 32 comprises a pressure reducing valve, a pressure gage or manometer, and a check valve. One supply conduit leads from pressure adjustment device 30 to the cylinder chambers of hydraulic motors 26 which face rail 3 for reciprocation of end tamping tools 9. Another hydraulic fluid supply conduit leads from pressure adjustment device 31 to the two outer cylinder chambers of hydraulic motors 25 farthest removed from rail 3. A still further hydraulic fluid supply conduit leads from pressure adjustment device 32 to the two outer cylinder chambers of hydraulic motors 25 closest to rail 3. The two latter hydraulic motors 25 reciprocate the crib tamping tools 8 which are immersed in the crib between the two ties being tamped while the two former hydraulic motors 25 farthest removed from rail 3 reciprocate tamping tools 8 which are immersed in the two cribs bounding the two tamped ties. The two facing cylinder chambers of hydraulic motors 25 closest to the rail are connected to pressure fluid reservoir 33 while the two cylinder chambers of hydraulic motors 26 which are farthest from rail 3 are connected to pressure fluid reservoir 34. The pressure fluid supply from the reservoirs serves to return these tamping tools from their respective operative positions to their rest positions. Since the opening of these tamping tools may be effected at a speed slower than that required for squeezing these tamping tools during the tamping operation, a branch conduit supplies hydraulic fluid from tank 23 to pressure reservoirs 32, 34 by means of a lower capacity pump 35 which, for instance, delivers 60 liters of hydraulic fluid per minute. Opening of the tamping tools actuated by the hydraulic motors farthest from rail 3 is effected by hydraulic fluid supplied to the outer cylinder chambers of the hydraulic motors 25 farthest from rail 3 through a branch conduit leading thereto from tank 23, pump 27 delivering the fluid through pressure reduction device or throttle 36 which is mounted in this branch conduit between pump 27 and motors 25. Through another branch conduit, pump 27 also delivers hydraulic fluid to pressure adjustment devices 37, 38 respectively connected to vibratory drives 10, 11.

Pressure adjustment devices 30, 31, 32 and 37, 38 are arranged to permit a reduction of the throughput as well as the pressure of hydraulic fluid to the hydraulic motors operative to reciprocate and vibrate the tamping tools. Gage 39 for measuring and, preferably, indicating the throughput and pressure is associated with each pressure adjustment device. Such gages may be designed to measure the pressure, the pressure differential and/or the fluid throughput, and indicators are connected thereto to enable an operator to read the gaged pressure and/or fluid throughput.

The hydraulic fluid flow and pressure is regulated from central control 19. A separate electric control circuit line connects each pressure adjustment device 30, 31, 32, 37, 38 and pressure throttle 36 to control 19. The gage 39 of each pressure adjustment device transmits a signal corresponding to the gaged pressure and fluid throughput back to the control to facilitate the control of the operation by an operator at control 19. It may be useful for this control operation to provide additional gages in the hydraulic supply system.

The supply of hydraulic fluid to hydraulic motors 25 for squeezing the crib tamping tools 8 is controlled by solenoid valve 29 connected to control device 19 while the supply of hydraulic fluid to hydraulic motors 26 for squeezing the end tamping tools 9 is controlled by solenoid valve 28 also connected to control device 19, timing device 40 being arranged between the solenoid of valve 28 and control device 19 to delay or accelerate the operation. The timing device comprises an adjustment element cooperating with a scale for adjusting the device.

The central control of the reciprocating and vibrating drives makes it possible to adjust the pressures of all tamping tools and the frequency of their vibrations rapidly and in proper cooperative relationship to adapt them to local operating conditions and so as to assure uniform tamping over long track sections, regardless of the extent of leveling required at different points.

Figure 5:
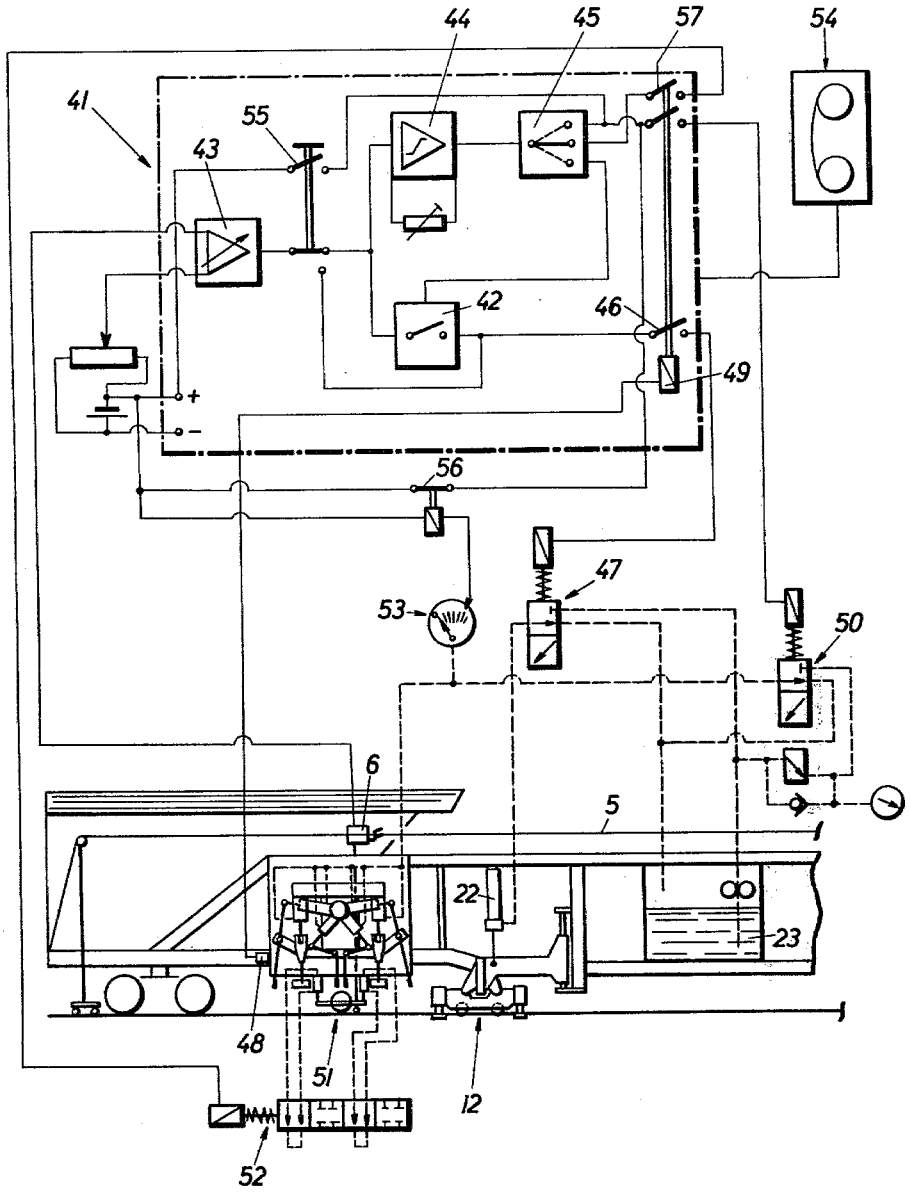
FIG. 5 is a diagram of the control circuit for operating the machine to tamp and level the track.

FIG. 5 schematically shows control circuit 41 for the operation of crib and end tamping tools 8, 9 and track holding unit 12. As shown in the drawing, the error signal from reference signal pickup and transmitter 6 is transmitted to sum-and-difference amplifier 43 which comprises an adjustable resistance set to indicate the desired value, the error signal being compared with the set value in the amplifier. The comparison signal is transmitted from amplifier 43 to stepping switch 44 whose switching steps are adjustable. Depending on the adjustment of the switch, contact 45 is actuated in response to the comparison signal received, which contact places the drives for reciprocation of the tamping tools and for track holding unit 12 into a state of readiness. When switch 44 moves contact 45 into its lower position, as shown in FIG. 5, which produces a state of readiness for track lifting, switch 42 is operated to transmit the comparison or error signal directly to solenoid valve 47, which preferably is a servo valve. This valve is arranged in the hydraulic supply conduit leading from tank 23 to lifting cylinder 22 and opening thereof permits hydraulic fluid flow to the cylinder for lifting unit 12, and thus the track, in response to the error signal. However, track lifting as well as reciprocation of the tamping tools is effected only when limit switch 48 affixed to the machine frame in the path of the vertical movement of tamping tool assembly 7 is tripped upon lowering of the tamping tool assembly, the limit switch being connected to relay 49 which actuates control switch 46 in the electrical connection between switch 42 and servo valve 47. The relay also actuates control switches 57 for operation of the tamping tools so that, depending on the position of contact 45 controlled by switch 44, servo valve 47 controlling the track lifting or servo valve 50 controlling the tamping tool reciprocation is actuated.

The machine operation is controlled in the following manner:

When the comparison or error signal detected and transmitted by amplifier 43 is below the tolerance, i.e. the switching step, set at switch 44, contact 45 connected to switch 44 is in the illustrated upper position, placing the hydraulic supply to the tamping tool drives into a state of readiness. When the error signal surpasses the set tolerance, switch 44 moves contact 45 from its upper end position to its lower end position to close switch 42 and place the hydraulic supply to lifting unit 12 into a state of readiness. Assuming control switches 46 and 57 to be closed upon tripping of limit switch 48 caused by lowering of the tamping tool assembly, servo valve 47 will be opened and the track will be raised by unit 12 as long as the error signal value exceeds that of the set switching step and until it is equal thereto, after which, i.e. in the period between the set switching step value and the value of the desired level, servo valve 47 is closed and servo valve 50 remains open so that further lifting of the track will be effected only by compaction of the ballast by the squeezing tamping tools until the track has reached the desired level, closing of valve 47 locking unit 12 in in position so as to hold the track. At track points where the error signal is smaller than the set switching value, lifting of the track is accomplished solely by ballast compaction. For this contingency, i.e. for the case of a small lifting stroke solely effectuated by ballast tamping, it is useful to mount a track holding mechanism 51 in the range of the tamping tool assembly so as to avoid raising the track above the desired level determined by the reference system 5. In the illustrated embodiment, track holding mechanism 51 comprises two hydraulic cylinders for vertically moving the mechanism relative to the machine frame. The mechanism further includes means engaging the track rails. A fluid flow blocking device 52 is mounted in the hydraulic supply conduit to the cylinders of track holding mechanism 51, this blocking device being actuated electromagnetically and the solenoid for the actuation of blocking device 52 being connected to contact 45 for operation when the contact has reached the illustrated middle position indicating the desired level of the track, i.e. the track is held by mechanism 51 at the desired level against further upward movement by tamped ballast. This avoids excess lifting of the track beyond the desired level during tamping. When the tamping tool assembly is raised, limit switch 48 will open relay 49, thus opening control switches 57 and blocking device 52.

As indicated by the chain-dotted lines in FIG. 5, the amplifier and switches of the control circuit 41 are mounted on a panel to simplify the operation and possible repairs, the entire panel being replaceable in case of break-downs.

A throw-over switch 55 is also mounted on the panel in the connection between amplifier 43 and switch 44, operation of switch 55 cutting out switch 44 and contact 45 from the control circuit and transmitting the error signal from the amplifier directly to servo valves 47 and 50, causing the track to be lifted solely by unit 12 and not by tamping of the ballast. It is also possible so to set switch 44 that the track will be lifted by unit 12 up to the desired level when the error signal exceeds the switching step and the tamping tools only tamp the ballast while, as previously explained, error signals smaller than the switching step set at switch 44 will cause track lifting solely by means of ballast tamping.

A master pressure gage 53, which is preferably associated with a pressure indicator, is mounted in the hydraulic supply conduit for the tamping tool drivers so as to make it possible to obtain and control the desired degree of ballast compaction by squeezing of the tools. Master switch 56 in the electrical control circuit is connected to pressure gage 53, a relay for the actuation of the master switch being responsive to a set maximum pressure to open the master switch and thus to interrupt a direct circuit controlling hydraulic fluid supply to the tamping tool drives. This direct control circuit is in shunt with switch 44 and contact 45 so that ballast tamping is continued until the set maximum degree of ballast compaction against the counter pressure of track holding device 51 has been reached even when the track has been lifted to the desired level. In its simplest, illustrated form, the master switch is constituted by an adjustable contact associated with the indicator of a contact manometer.

After tamping has been completed, the tamping tool assembly is raised and opened limit switch 48 will actuate relay 49 so as to interrupt hydraulic fluid flow to the tamping tool drives and holding units 12 and 51. The mobile machine is then advanced by a distance of two ties to start the next tamping and leveling cycle.

Fully automatic operation of control 41 may be achieved by connecting the control circuit, and also control 19, if desired, to a suitable programmer 54 operating on an analog or digital computer basis, thus relieving the operator of any control function and enabling him to concentrate on adjusting the operating results. Such a programmer will automatically control the degree of tamping, the tamping tool reciprocating times and pressures as well as the frequency and/or amplitude of the tamping tool vibrations in response to data transmitted to the programmer by the pressure adjustment devices and corresponding to the condition of the ballast. Such data may be stored, for instance, on perforated bands or cards, or magnetic tapes.

A track surfaced with a tamping and leveling machine of the above described structure will be much more uniformly tamped than has been possible with conventional machines and will thus assure greater stability of the graded track. This will make it possible to increase the length of the time intervals between surfacing operation so as to obtain considerable economy in the maintenance of tracks of a high quality.

What is claimed is:

1. A method of obtaining a controlled degree of ballast compaction in the tamping and levelling of a track consisting of rails mounted on ties having two elongated edges extending transversely of the rails and two ends extending in the direction of the rails, the rails and ties intersecting at points spaced in the direction of elongation of the track and the ties resting on ballast, the tract being lifted to a leveled position in relation to a reference system and ballast being tamped under the ties independently of the lifting, comprising the steps of (1) compacting the ballast under the points of the intersection by vibratory pressure exerted upon the ballast under the ties inwardly from the two longitudinal tie edges and from the tie ends whereby the progressively more compacted ballast raised the track, and (2) holding the track in the region of tamping locked against upward movement in the leveled position determined by the reference system, (a) the ballast being tamped against the held track until it has reached the controlled degree of compaction and the track being held against upward movement out of the leveled position under the tamping pressure.

2. The method of claim 1, wherein the degree of ballast compaction is controlled by correlating the vibratory pressures in the direction of and transversely to the rails.

3. The method of claim 1, wherein the track is independently lifted from the actual to the leveled track position.

4. The method of claim 1, wherein the track is brought to the leveled track position by the progressively more compacted ballast and by lifting independent thereof.

5. A method of lifting a rail of a railroad track and tamping ballast therebeneath comprising jacking the rail, lifting a rail-engaging stop means by said rail, referring said stop means to a track surface reference system and locking said stop in position engaging said jacked rail, simultaneously terminating said jacking and tamping the ballast beneath the rail against the limiting action of said locked stop means.

6. A method as claimed in claim 5, in which the limiting action of said stop means is applied immediately adjacent the point of tamping and of lifting.

7. Apparatus for lifting a rail of railroad track and tamping ballast therebeneath comprising a track surface reference system to provide a track surface datum; track traveling frame means; track jacking means on said frame; rail-engaging stop means in continuous engagement with the rail and floatingly mounted on said frame means for free up and down movement thereon; reference system detecting means connected to said stop means; means responsive to the detection of said datum by said detecting means to generate a signal to terminate a track jacking operation of said jacking means and simultaneously to lock said stop means relative to said frame means; and ballast tamping means mounted on said frame means to tamp the ballast beneath the rail against the reaction of said locked stop means.

8. Apparatus as claimed in claim 7 in which stop means is positioned directly above the point of tamping.

9. Apparatus as claimed in claim 7 in which said tamping means comprise tamping units of the vibratory squeeze type, said stop means being positioned longitudinally of the track between said units.

10. A method of levelling a track consisting of rails mounted on ties and tamping ballast thereunder, the track being lifted to a leveled position in relation to a reference system and ballast being tamped under the ties independently of the lifting, comprising the steps of (1) holding the track locked against upward movement in the leveled position under the control of the reference system in the region of tamping, and (2) tamping the ballast under the ties by vibratory pressure while the track is held against upward movement out of the leveled position under the tamping pressure.

11. The method of claim 10, wherein the track is first lifted independently towards the leveled position and the ballast is then tamped after independent lifting has been terminated.

12. Apparatus for levelling a track consisting of rails mounted on ties and tamping ballast thereunder, comprising the combination of (1) a reference system and means for lifting the track to a leveled position in relation to the reference system, (2) tamping means for tamping the ballast by vibratory pressure.

(3) means in the region of the tamping means for holding the track locked against upward movement at a leveled position determined by the reference system, and (4) means for locking the holding means in said position under the control of the reference system whereby the track is held against upward movement out of the leveled position under the tamping pressure.

13. A method of lifting a rail of a railroad track and tamping ballast therebeneath comprising jacking the rail, lifting a rail-engaging stop means with said rail, referring said stop means to a track surface reference system and locking said stop in position engaging said jacked rail, simultaneously terminating said jacking and tamping the ballast beneath the rail against the limiting action of said locked stop means.

14. A method as claimed in claim 13 in which the limiting action of said stop means is applied immediately adjacent the point of tamping and of lifting.

15. Apparatus for lifting a rail of railroad track and tamping ballast therebeneath comprising a track surface reference system to provide a track surface datum; track travelling frame means; track jacking means on said frame; rail engaging stop means in continuous engagement with the rail and mounted on said frame means for up and down movement therewith; reference system detecting means connected to said stop means; means responsive to the detection of said datum by said detecting means to generate a signal to terminate a track jacking operation of said jacking means and simultaneously to lock said stop means relative to said frame means; and ballast tamping means mounted on said frame means to tamp the ballast beneath the rail against the reaction of said locked stop means.

16. Apparatus as claimed in claim 15 in which stop means is positioned directly above the point of tamping.

17. Apparatus as claimed in claim 15 in which said tamping means comprise tamping units of the vibratory squeeze type, said stop means being positioned longitudinally of the track between said units.

* * * * *